United States Patent [19]

Smith

[11] Patent Number: 4,848,818

[45] Date of Patent: Jul. 18, 1989

[54] GUTTER CLEANING TOOL, WITH A MULTI-POSITIONAL AND SELF-LOCKING JOINT, THAT CAN BE REMOTELY OPERATED BY HAND FROM AN OBLIQUE ANGLE

[76] Inventor: Gordon K. Smith, 7325 92nd St., NW., Gig Harbor, Wash. 98335

[21] Appl. No.: 145,045

[22] Filed: Jan. 19, 1988

[51] Int. Cl.[4] ..... E04D 13/06

[52] U.S. Cl. ..... 294/19.1; 15/236.04; 294/53.5; 294/55; 403/97; 403/116

[58] Field of Search ..... 294/19.1, 22, 53.5, 294/54.5, 55; 15/144 R, 144 A, 236 R, 257.7, 236.04; 403/53, 57, 58, 97, 101, 103, 116, 117

[56] References Cited

U.S. PATENT DOCUMENTS

| | | | |
|---|---|---|---|
| 333,173 | 12/1885 | Taylor | 294/55 X |
| 1,268,734 | 6/1918 | Lay | 403/97 X |
| 1,800,349 | 4/1931 | Hurason | 403/97 X |
| 2,299,418 | 10/1942 | Thomas | 294/55 |
| 2,618,501 | 11/1952 | Tallant | 294/55 |
| 3,773,375 | 11/1973 | Nehls | 294/54.5 X |
| 3,858,267 | 1/1975 | Swannie | 294/19.1 X |
| 3,888,534 | 6/1975 | Hall et al. | 294/19.1 |
| 4,447,927 | 5/1984 | Malless | 294/19.1 X |
| 4,640,540 | 2/1987 | Chisholm | 294/55 |

FOREIGN PATENT DOCUMENTS

| | | | |
|---|---|---|---|
| 57597 | 2/1953 | France | 294/53.5 |
| 1559925 | 1/1980 | United Kingdom | 294/19.1 |

*Primary Examiner*—Johnny D. Cherry

[57] ABSTRACT

The tool of the present invention is comprised of a scoop with a short upright stem which is connected to a threaded broom handle of any length thru a multi-positional, self-locking, rotary acting articulated joint. Opposing surfaces of both members of the joint are constructed with raised ridges designed and constructed such that when these surfaces are placed proximate one another, the ridges exactly interlock, and, when secured with a nut, bolt, washers and compression spring affixed thru a hole bored thru the center of the surfaces, the interlocking ridges will tend to hold the joint, and hence the scoop, in any of a number of positions as selected by the user. If desired the nut can be locked to overcome the compression spring thus securing the joint against forceable movement establishing a firm, shovel-like effect. The stem of the scoop is secured to the joint by means of a pin inserted at right angles thru the stem and thru slots cut into the joint member, constructed so as to provide for lateral movement of the scoop around the vertical aspect of the stem. This construction provides for necessary lateral movement of the scoop as it is negotiated thru the gutter by the operator. The operator by means of a long broom handle may thus remotely control the scoop thru the gutter from a convenient and standing position on the roof or from a ladder.

8 Claims, 3 Drawing Sheets

GUTTER CLEANING TOOL, WITH A MULTI-POSITIONAL AND SELF-LOCKING JOINT, THAT CAN BE REMOTELY OPERATED BY HAND FROM AN OBLIQUE ANGLE

BACKGROUND AND SUMMARY OF THE INVENTION

This invention relates to a tool for cleaning debris out of gutters and in particular to such a tool that is constructed with a multi-positional, self-locking, rotary acting articulated joint that is capable of allowing free and remote operation by hand upon attachment of a long broom handle.

Gutters placed on the roof edges of buildings collect and control the flow of roof water drainage. However, along with water, debris consisting of leaves, needles, dirt and all manner of airborne detritus is also collected and must be disposed of if the gutter system is to continue to be effective.

To accomplish the task of debris removal, numbers of devices generally constructed in the form of a short scoop have been devised for use. However, all such devices have had short handles and other substantial deficiencies requiring the user, when cleaning gutters from the roof, to assume the uncomfortable position of kneeling or crawling along the gutter, usually in one direction, or, if operating from a ladder, to continually reposition the ladder against the gutter due to physical limitations of reach.

There remained a need for a tool devised and constructed in such a manner as to allow the user to clean gutters from both sides of a roof position while standing or walking upright, or, if operating from a ladder placed against the gutter, to have the capability of extended reach from both sides of the ladder position so as to preclude continual repositioning of the ladder.

The tool of the present invention fulfills the foregoing requirements by providing a tool consisting of an elongated and somewhat narrow rigid scoop, molded so as to fit easily into both rounded and flat-bottomed gutters, and constructed with a right-angled stem that is inserted into the first member of a two member multi-positional and self-locking rotary acting articulated joint constructed to accept the stem in a tight fit and secured in the joint member by a pin and slot arrangement. One end of the second member of the joint is molded to receive a typical broom handle thread. The juxtaposed surfaces of the joint members are molded in a flat circular configuration with molded traingulate ridges radiating out from a central locus to the edges of the surfaces. The ridges are constructed such that when these surfaces are placed in opposition the ridges will exactly interlock, and, when secured with a properly adjusted nut, bolt and compression spring arrangement inserted thru a hole bored thru the center locus of the ridges, will maintain a selected fixed position. If the ridges are forced of sufficient magnitude to overcome the compression spring past each other by an outside force a new position relative to the preceeding one will be achieved and maintained. As a result, a range of user selectable positions are available and may be described as those occurring within a half circle. Thus this joint arrangement will provide all the positions necessary for the user to push, pull, drag and scoop unwanted gutter material thru and from the gutter system. Further, the joint may be locked at any selected position to provide a firm shovel effect by completely tightening the nut against the side of the joint.

The scoop is constructed long enough and with side walls low enough to enable the user to push, or pull, gutter material under the supports that attach the gutter to the roof, thus insuring that the entire gutter may be effectively cleaned. The stem of the scoop is of sufficient length to ensure that the attached joint is elenated above the shingle surface of the roof when the scoop is fully inserted into the gutter, thus ensuring that the joint will be fully functional.

The pin and slot arrangement that secures the stem in the first joint member provides for limited lateral movement of the scoop which is necessary when the scoop is being negotiated thru the gutter system. The lateral movement also provides this benefit to the user of safer roof and ladder operating conditions since the lateral motion of the scoop allows operation from an oblique angle.

The leading bottom edge of the scoop is molded into a cutting edge to enable the user to cut thru matted gutter material.

Accordingly, it is a principle object of the present invention to provide a tool for cleaning gutters which is constructed with a multi-positional and self-locking rotary acting articulated joint that allows for a variety of user selected positions which allows for free and remote operation by hand upon attachment of a long broom handle.

It is a further object of the present invention to provide such a tool which will allow the user to clean gutters from both sides of a roof or ladder position.

It is a further object of the present invention to provide such a tool which will allow the user to clean gutters from a roof position while comfortably standing or walking upright on the roof.

It is a further object of the present invention to provide such a tool which will provide for a firm shovel effect when the joint is locked at any selected position by completely tightening the nut against the side of the joint.

It is a further object of the present invention to provide such a tool in which the scoop is constructed long enough and with side walls low enough to push, or pull, gutter material under the supports that attach the gutter to the roof such that the entire gutter may be effectively cleaned.

It is a further object of the present invention to provide such a tool with a right-angled stem of sufficient length to ensure that the attached joint is elenated above the shingle surface of the roof when the scoop is fully inserted into the gutter, thus ensuring that the joint will be fully functional.

It is a further object of the present invention to provide such a tool in which the stem of the scoop is secured in the first member of the joint by a pin and slot arrangement which provides for limited lateral movement of the scoop necessary when the scoop is being negotiated thru the gutter.

It is a further object of the present invention to provide such a tool in which the lateral movement of the scoop provides the user safer roof and ladder operating conditions since the scoop can be operated from an oblique angle.

It is a further object of the present invention to provide such a tool in which the bottom leading edge of the scoop is molded with a cutting edge that will cut thru matted gutter material.

The foregoing and other objectives, features and advantages of the present invention will be more readily understood upon consideration of the following detailed description of the invention taken in conjunction with the accompanying drawings.

DRAWINGS

A preferred embodiment of this remote hand operated tool used for cleaning material buildup from gutters installed on buildings, is illustrated in the drawings, wherein.

DESCRIPTION OF THE PREFERRED EMBODIMENT

Figure 1A:
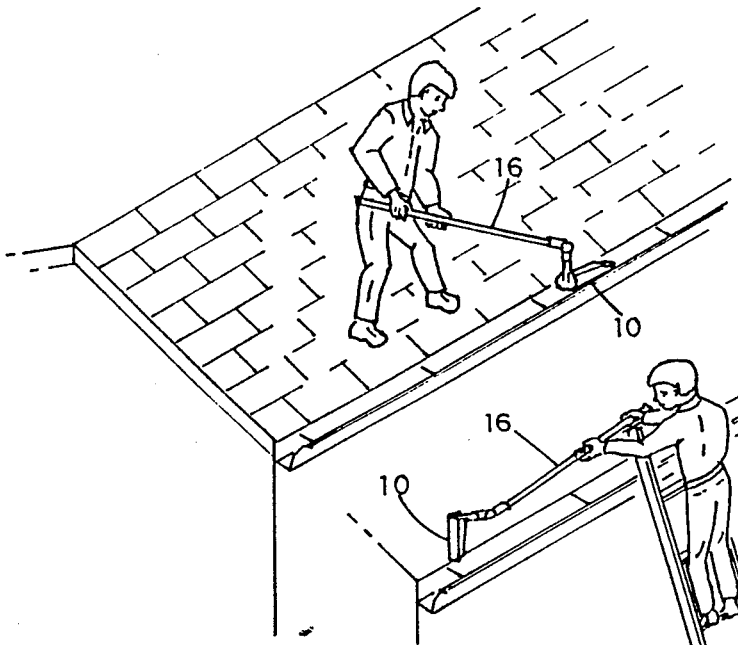
FIGS. 1A and 1B are perspective views of a building gutter showing general use of this remote hand operated tool from a position on the roof (FIG. 1A) with the user standing or walking and with the user on a ladder positioned against the gutter (FIG. 1B).
Figure 1B:
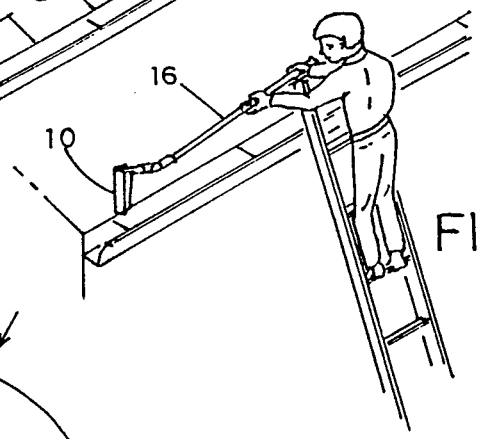

FIGS. 1A and 1B depict two of many available positions of the tool that can be selected by the user when operating from a roof or ladder position.

Figure 3:
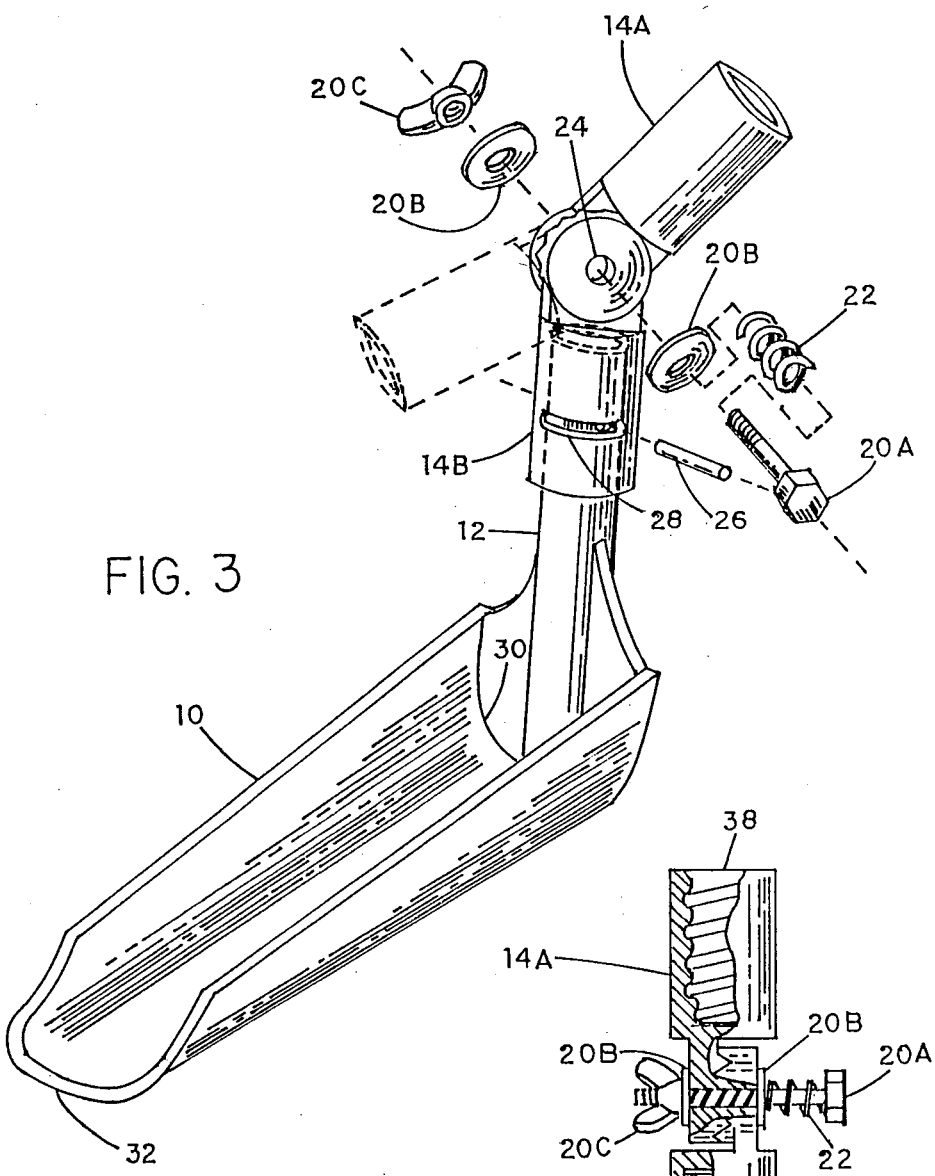
FIG. 3 is a perspective view of the tool depicting the general arrangement of the scoop, right-angled stem and the joint members with details of the pin and slot and the nut, bolt, washers and compression spring in proper arrangement. An additional position of the threaded joint member is indicated with dashed lines.
Figure 4:
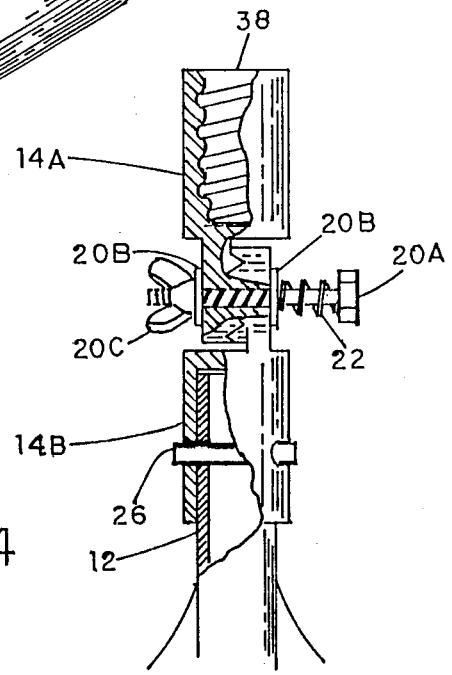
FIG. 4 is a cross-sectional view of the joint installed on the stem of the scoop detailing the position of the stem in the first member, construction of the pin and slot, details of the nut, bolt, washers and compression spring fastening arrangement and a view of the molded threaded receptacle of the second joint member.
Figure 5:
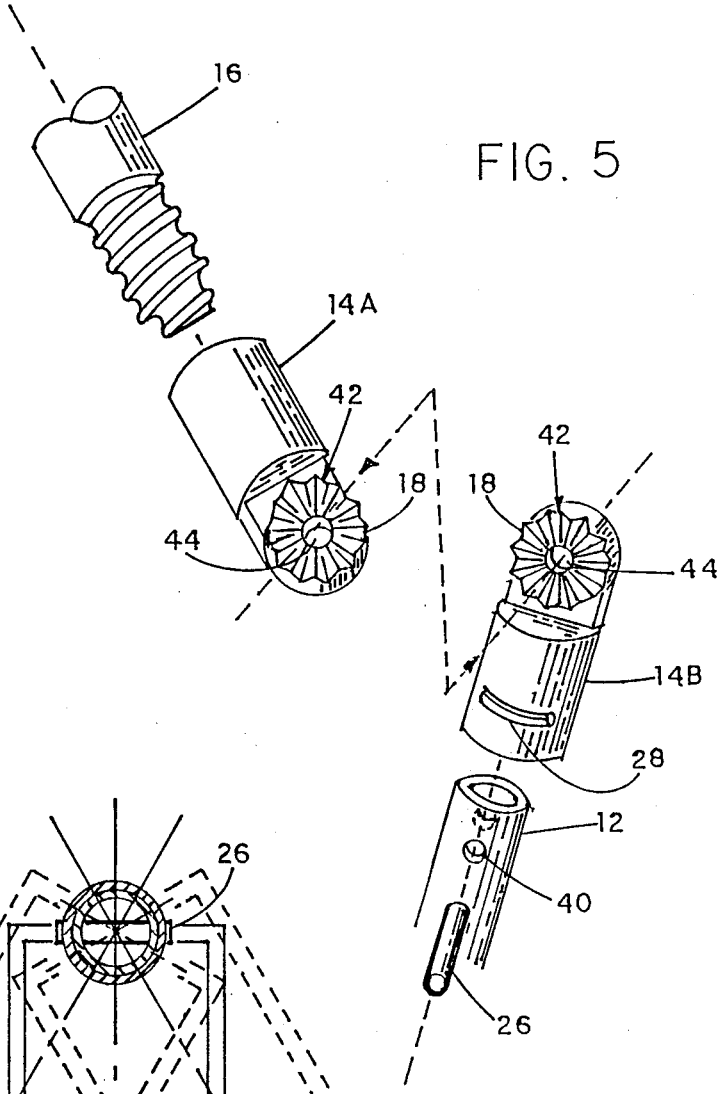
FIG. 5 is an exploded view of the joint showing details of the pattern of triangulate ridges on the apposing surfaces of the joint radiating outwards from a central locus, the position of the hole bored thru the apposing joint members that will accept the fastener and the bored hole in the stem thru which the pin is inserted.

Referring to FIGS. 3, 4 and 5, the preferred embodiment of this invention consists of a molded scoop 10 with a right-angled stem 12 which is connected to a threaded broom handle 16 thru a multi-positional and self-locking rotary acting articulated joint 14A and 14B.

Figure 6:
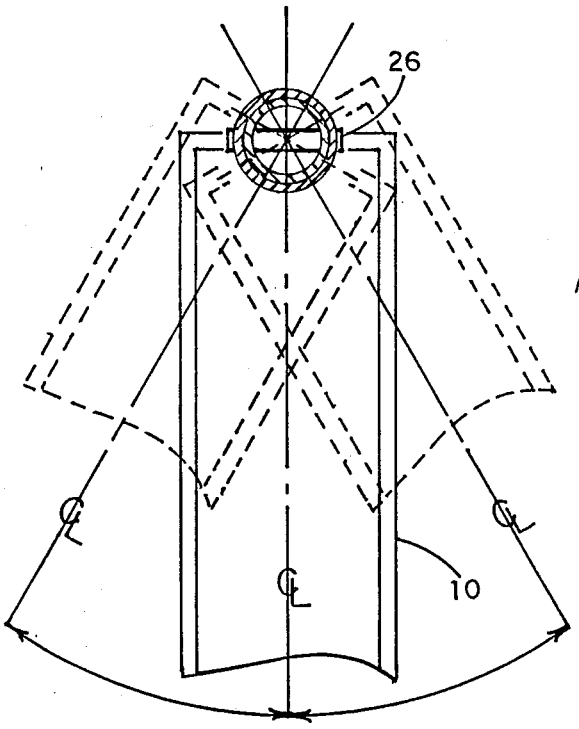
FIG. 6 is a plan view of the pin and slot showing the range of limited lateral movement of the scoop around the vertical axis of the stem, the extreme positions of the scoop being depicted as dashed lines.

The first member of the joint 14B is constructed so as to receive the stem 12 of the scoop in a tight fit. The stem 12 is secured into the joint member 14B with a pin 26 inserted thru a hole 40 bored thru the stem, and ultimately thru elongated horizontal slots 28 situated on opposite sides of the first joint member 14B. The pin 26 thus acts to hold the stem in correct position within the first member while the slots 28 allow the scoop 10 to be rotated around the vertical axis of the stem allowing for a limited lateral movement (FIG. 6) of the scoop.

The overall length of the stem 12 is determined by the depth of the gutter, since to be fully functional, the joint 14A and 14B must be elenated above the shingle surface of the roof when the scoop is fully inserted into the gutter cavity.

The second joint member 14A is molded with a broom handle thread 38 so that when a handle 16 is threaded into this threaded receptacle, the tool may then be remotely operated by hand.

Figure 2:
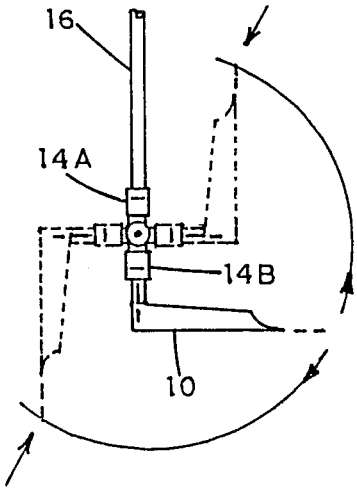
FIG. 2 depicts the range of selectable positions of the tool around the multi-positional joint with additional positions in dashed lines.

The opposite surfaces 42 of the second and first joint members 14A and 14B are constructed with triangulate ridges 18 that radiate from a central location 44 on these surfaces. The design and construction of these ridges 18 is such that when the surfaces 42 are placed against each other, the ridges will exactly interlock, and when properly secured with a bolt 20A, washers 20B, nut 20C and compression spring 22, affixed thru a hole 24 bored thru both joint members, the interlocking ridges 18 will act to restrict rotary movement (FIG. 2) allowing the joint,, hence the scoop, to maintain a variety of selected positions against outside force. Once the opposing ridges are forced past each other and the force released, a new position is established and held until another position is selected.

The joint 14A and 14B may be locked by the action of securely tightening the nut 20C which will compress the spring 22, thereby totally restricting the movement of the interlocking ridges 18 past each other. This action will provide for a firm shovel effect.

The scoop is molded with a slightly rounded configuration 30 so as to provide surface contact in both square and rounded gutters. The scoop 10 is constructed long enough to operate under and past gutter support bracing so that material scooped up remains within the scoop as the scoop is withdrawn and emptied prior to reinsertion in the gutter beyond the blocking support. The bottom leading edge 32 of the scoop 10 is molded into a cutting edge which will cut thru matted gutter material.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool for removing debris from a rain gutter, said tool comprising:

(a) a rigid and generally U-shaped scoop having an open end, a closed end, side walls and an integral bottom;

(b) an elongate stem situated at said closed end of said scoop constructed at right angles to the longitudinal axis of said scoop, the axis of said stem considered to be in a vertical position when said scoop is inserted into a gutter cavity;

(c) a rotary acting, multi-positional self-locking articulated joint mounted on the distal end of said elongate stem, said joint consisting of first and second joint members and constructed with flat proximal and tubular distal ends, having;

a plurality of raised ridges radially arranged about a a central locus on said proximal ends of said first and second joint members constructed to exactly interlock when the proximate ends of said first and second joint members are juxtaposed;

said juxtaposed joint members affixed with a properly adjusted bolt, nut and compression spring to provide an inwardly directed force sufficient to prevent movement of the joint until overcome by an outside force of sufficient magnitude to move the joint to a new position;

said tubular distal end of said first joint member constructed with a receptacle to accept said distal end of said elongate stem;

said tubular distal end of second joint member constructed with a receptacle to receive an elongate handle;

(d) said first joint member affixed to said distal end of said elongate stem by a pin and slot arrangement considered to define the range of lateral movement of said scoop around said axis of said stem, consisting of two elongated slots constructed thru the sides of said receptacle of said first joint member and situated exactly opposite each other, said slots positioned perpendicular to the axis of said receptacle, through which a pin of appropriate length is inserted thru one slot situated on one side of said receptacle of said first joint member then entirely thru a properly positioned bored hole in the properly inserted said elongate stem, after which said pin shall pass unimpended thru the second slot situated exactly opposite the first slot of said receptacle, whereupon said pin is considered in its final resting position, said pin and slot arrangement providing a means to restrict the range of lateral movement of said scoop around the axis of said elongate stem.

2. The tool of claim 1 wherein said elongate stem is of such length as to insure said joint remains elevated above and outside the confines of said rain gutter to insure full and unrestricted movement of said joint when said scoop is fully inserted into said rain gutter.

3. The tool of claim 1 wherein said receptacle of said first joint member is constructed to accept said elongate stem of said scoop with a fit of sufficient tightness that acts to restrict the ease of movement of said stem within said receptacle.

4. The tool of claim 1 wherein said raised ridges are triangulate in shape to allow said raised ridges to more easily slide over each other as said joint is moved into a new position.

5. The tool of claim 1 wherein said joint is capably lockable against any movement upon completely tightening said nut to completely overcome the strength of said compression spring.

6. The tool of claim 1 wherein said lateral movement provides means of operational control of said scoop in said gutter cavity from an oblique angle sufficient to provide for increased operator safety.

7. The tool of claim 1 wherein said receptacle of said second joint member is internally constructed with a thread to receive the external threads of a typical broom handle.

8. The tool of claim 1 wherein said closed end, said side walls and said integral bottom of said scoop are constructed smooth so as to permit easy disposal of gutter material.

* * * * *